United States Patent [19]

Mersereau et al.

[11] 4,003,565

[45] Jan. 18, 1977

[54] DISENGAGING APPARATUS FOR A COLLATOR

[75] Inventors: Robert E. Mersereau, Stamford; Michael A. Brown, Norwalk, both of Conn.

[73] Assignee: Pitney-Bowes, Inc., Stamford, Conn.

[22] Filed: Oct. 20, 1975

[21] Appl. No.: 623,609

[52] U.S. Cl. ..... 270/58

[51] Int. Cl.[2] ..... B65H 29/045

[58] Field of Search ..... 270/58–60, 270/12, 15; 271/64, 173

[56] References Cited

UNITED STATES PATENTS

| | | | |
|---|---|---|---|
| 2,479,060 | 8/1949 | Davidson | 270/58 |
| 2,753,180 | 7/1956 | Thomas | 270/58 |
| 2,919,917 | 1/1960 | Worswick | 270/58 |
| 2,940,750 | 6/1960 | Mestre | 270/58 |
| 3,540,721 | 11/1970 | Blowsky | 270/58 |

*Primary Examiner*—Edgar S. Burr
*Assistant Examiner*—A. Heinz
*Attorney, Agent, or Firm*—William D. Soltow, Jr.; Albert W. Scribner; Robert S. Salzman

[57] ABSTRACT

A collator system is disclosed, which allows a collator to operate in either one of two distinct modes: (a) RUN/REJECT; or (b) CYCLE/STOP. Each of the above modes of operation has a unique way of handling sheet feeding malfunctions. The RUN/REJECT mode allows the collator to continue to run, despite a sheet feeding malfunction. The stacks, or portions thereof, having an error are distinctly off-set from properly collated stacks. In the CYCLE/STOP mode, the collator feed is disengaged in accordance with the present invention and the drum is rotated at slow speed through a partial revolution and then brought to a stop. A pocket of the collating drum is thusly positioned in an operator accessible area, so that the malfunction may be easily corrected. The RUN/REJECT operational mode allows for automatic and continuous operation despite malfunctions, with corrections to improperly collated stacks to be processed after the completed collator run. The CYCLE/STOP operational mode allows the operator to easily correct any feeding malfunctions as they occur.

10 Claims, 13 Drawing Figures

FIG. 2
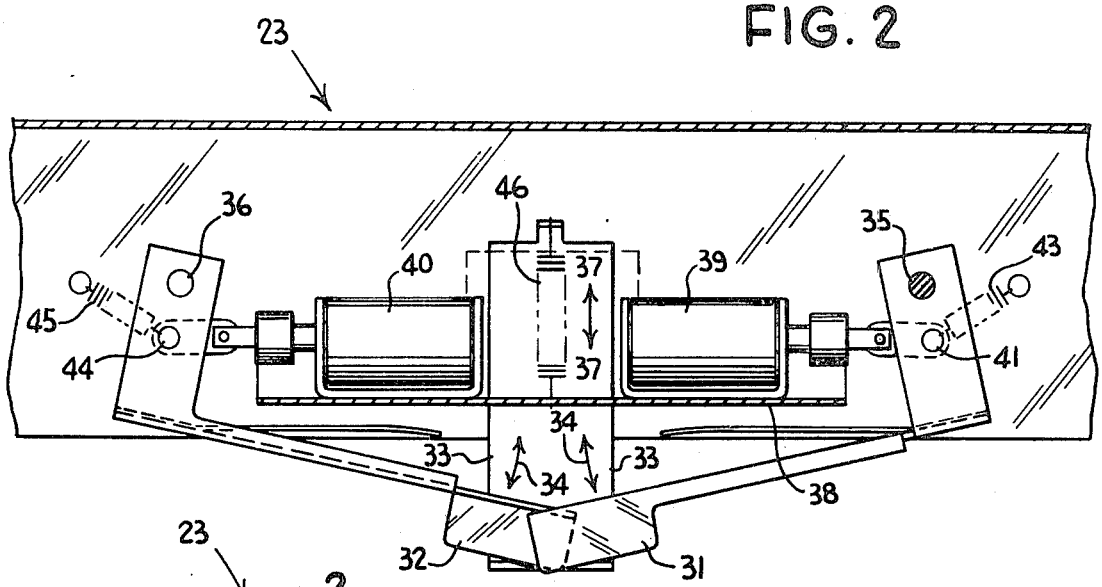
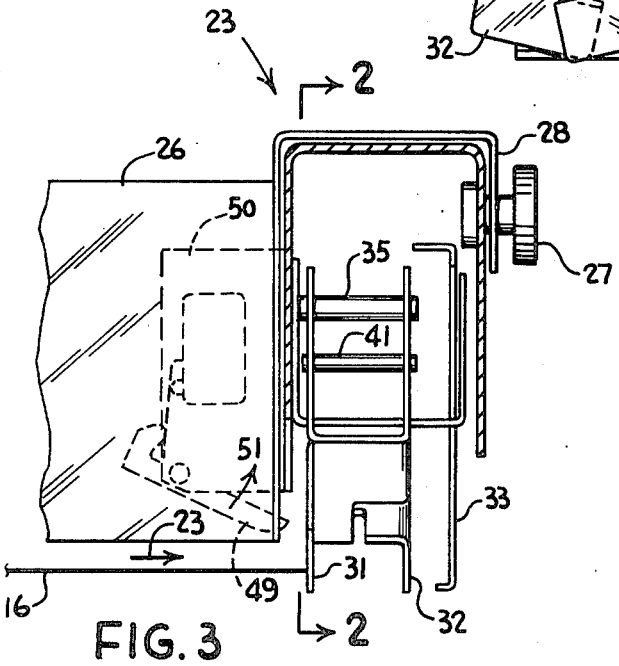
FIG. 3
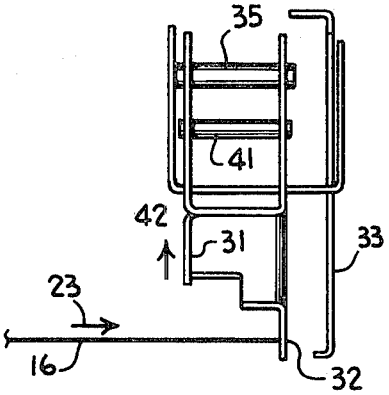
FIG. 3a
FIG. 3b
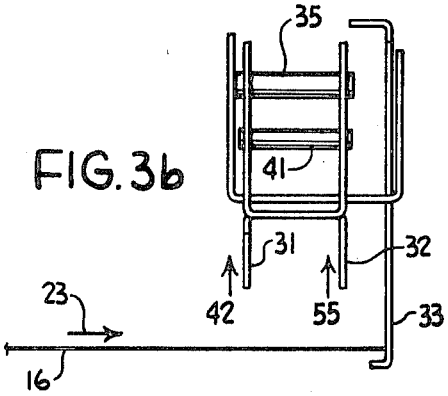
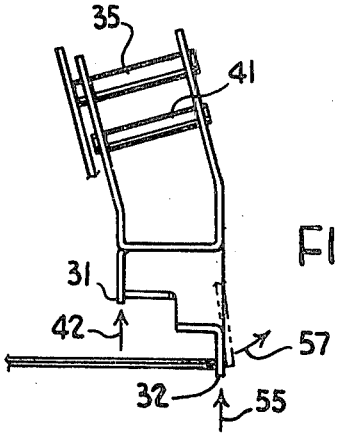
FIG. 3c FIG. 5a
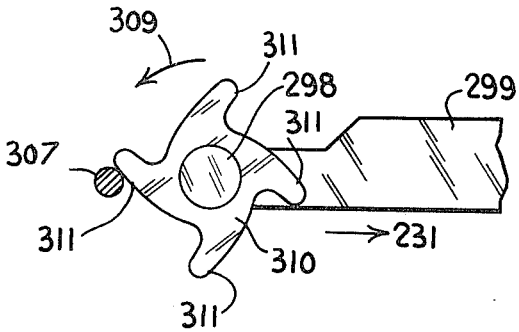
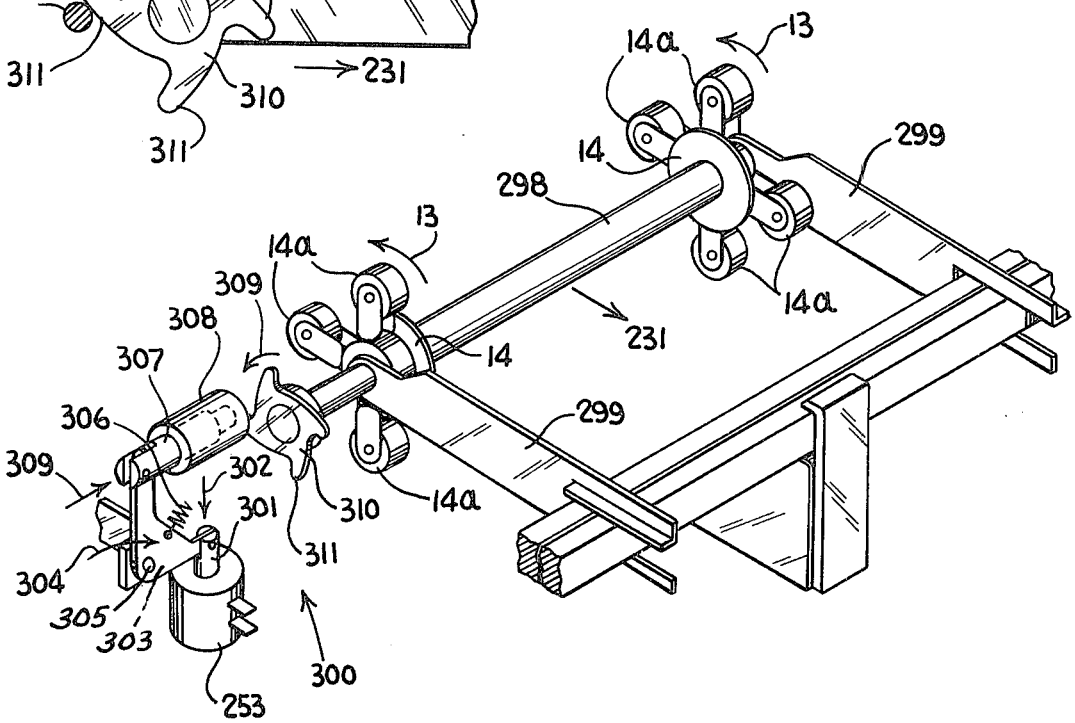
FIG. 5
FIG. 6
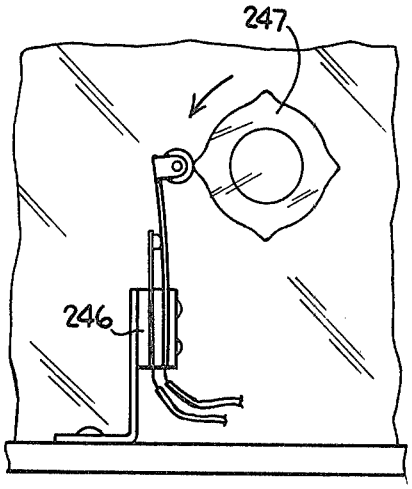

DISENGAGING APPARATUS FOR A COLLATOR

The invention pertains to a collator system, and more particularly to an improved collator system having an automatic disengaging apparatus for the collator feed apparatus.

BACKGROUND OF THE INVENTION

Heretofore, the problem of a sheet mis-feed or a sheet double-feed in a collating run was particularly cumbersome and annoying. Most collators are not equipped to handle sheet feeding malfunctions in a convenient manner. When a malfunction is detected, some machines come to an "abrupt" halt. Now it should be understood, that the inertia in a rotary drum collator will cause the drum to rotate through several pockets before coming to a complete stop. In any event, the malfunctioning pocket will normally rotate under the discharge deck. This of course, makes the pocket inaccessible, and correction of the malfunction becomes very cumbersome. In such a case, the operator has to open a trap door in the machine housing, and crouch within the housing to reach the drum.

In other collators, detection of a malfunction goes undetected, and improperly collated stacks are measured at the end of the collation to see if they are the proper thickness. Naturally, if there is a mis-feed, the stack will be too thin, and will be rejected. Also, if there is a double-feed, the stack will be rejected for being too thick. The disadvantage of this system is, that a mis-feed and a double-feed appearing in the same stack, will indicate the proper thickness. This improperly collated stack would be be erroneously accepted as a fit stack.

In most of these prior collators, there was no way to easily correct the mistakes, either during or after the collation.

The present invention is concerned with providing a collator system that will allow easy access and correction of interim malfunctions, and proper detection of subsequent improperly collated stacks.

SUMMARY OF THE INVENTION

The invention relates to a collator system which operates in either one of two novel and distinct modes: (A) RUN/REJECT; or (B) CYCLE/STOP. Each of these modes of operation has a unique way of handling sheet feeding malfunctions. The RUN/REJECT mode allows for continuous operation of the collator, despite the occurrence of any sheet feeding malfunction. The stacks, or portions thereof, having an error are distinctly off-set from properly collated stacks. This off-setting system provides for three off-set stacking positions. Two of these positions are provided for properly collated stacks, while the third position is a reject position for improperly collated stacks.

The stacking system has a stacking deck for receiving sheets of material from a sheet dispensing means such as a rotary drum. The deck supports the sheets in off-set stacks. Sensing means is disposed along a feed path between the sheet dispensing means (rotary drum) and the deck. The sensing means senses an improper feed condition. A threee-position stop means is disposed adjacent the stacking deck. This stop means stops incoming sheets received by the deck and positions them in off-set stacks. The stop means comprises first and second members that are each respectively movable between a stopping and a non-stopping sheet position. The second stop member is mounted behind the first stop member to stop the sheets when the first stop member is in a non-stopping sheet position. The first and second stop members are operatively connected and responsive to the sensing means. When the sensing means senses an improper feed condition, both the first and second stop members will be in their respective non-stopping sheet positions. A third stop member will stop the sheets, when the first and second stop members are in their non-stopping positions.

In the CYCLE/STOP mode, the collator is not on a continuous operating capacity. Rather, the sheet feeding mechanism will automatically disengage when a malfunction is sensed. The rotary drum of the collator is then rotated at a slow speed through a partial revolution and brought to a stop. A faulty pocket of the collating drum is thusly positioned in an operator accessible area, so that the malfunction may be easily corrected. In summation, the RUN/REJECT mode allows for automatic and continuous operation despite malfunctions, with corrections to be made after the completed collator run. The CYCLE/STOP mode allows for manually correcting the malfunctions as they occur. While the RUN/REJECT mode is applicable to all kinds of collators, the CYCLE/STOP mode is particularly applicable to rotary drum collators.

It is an object of this invention to provide an improved collator system;

It is another object of the invention to provide a collator system having two distinct and novel modes of operation.

It is a further object of this invention to provide a collator system with improved versatility and new operating capabilities.

These and other objects of this invention will become more apparent and will be better understood with reference to the following detailed description taken in conjunction with the accompanying drawings, in which:

FIG. 2 is a frontal internal view of an off-set stacking mechanism shown in FIG. 1;

FIG. 3 is a side view of the internal structure of FIG. 2;

FIG. 3*a* is a sectional view of FIG. 3 taken along lines 3—3, showing an alternate stop position to that illustrated in FIG. 3;

FIG. 3*b* is a similar view to that of FIG. 3*a* depicting a third stop position for the stopping mechanism;

FIG. 3*c* is a view of an alternate embodiment of the apparatus shown in FIG. 3*b;*

Figure 1:
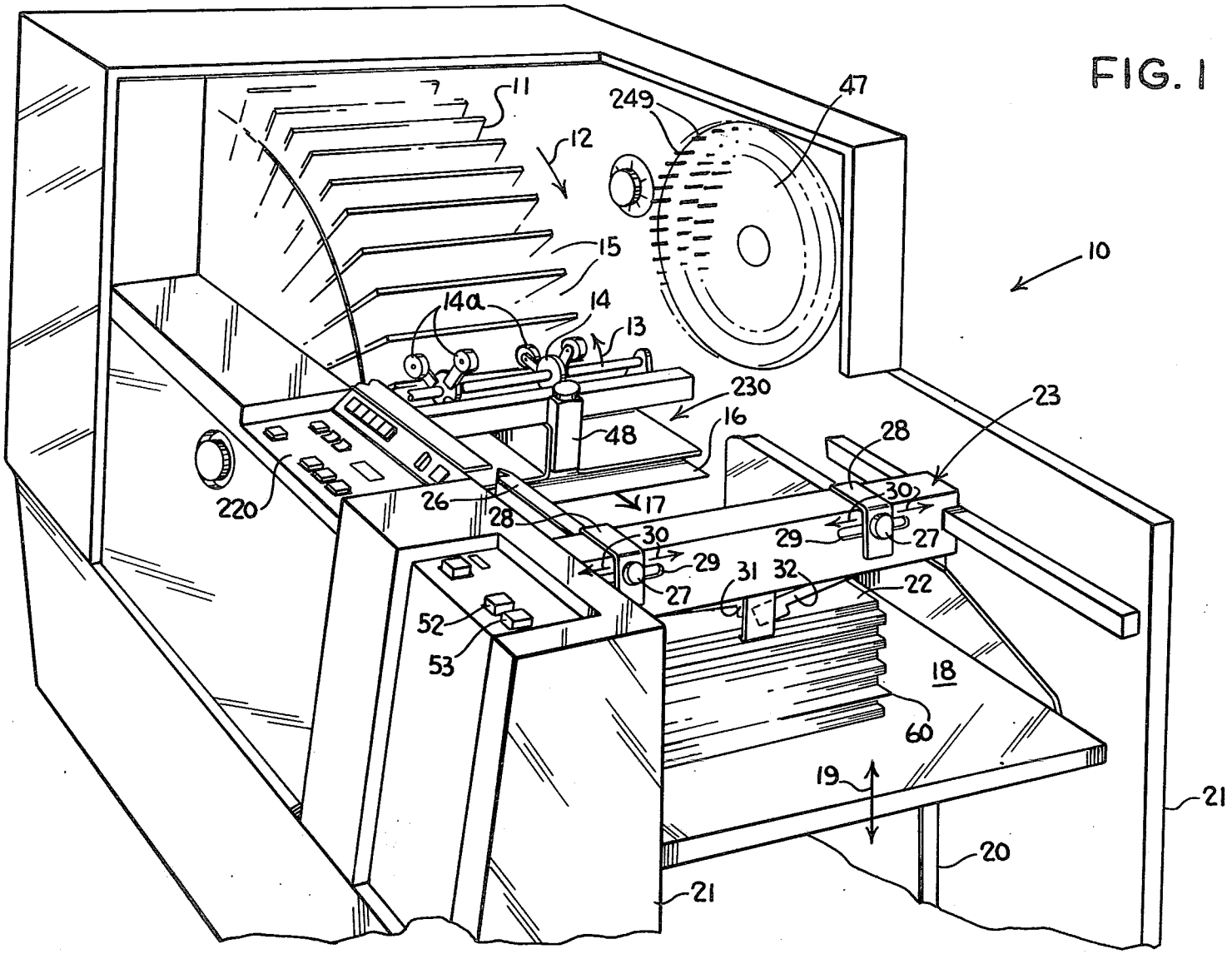
FIG. 1 is a perspective schematic view of a rotary drum collator embracing the operative system of this invention.
Figure 4A:
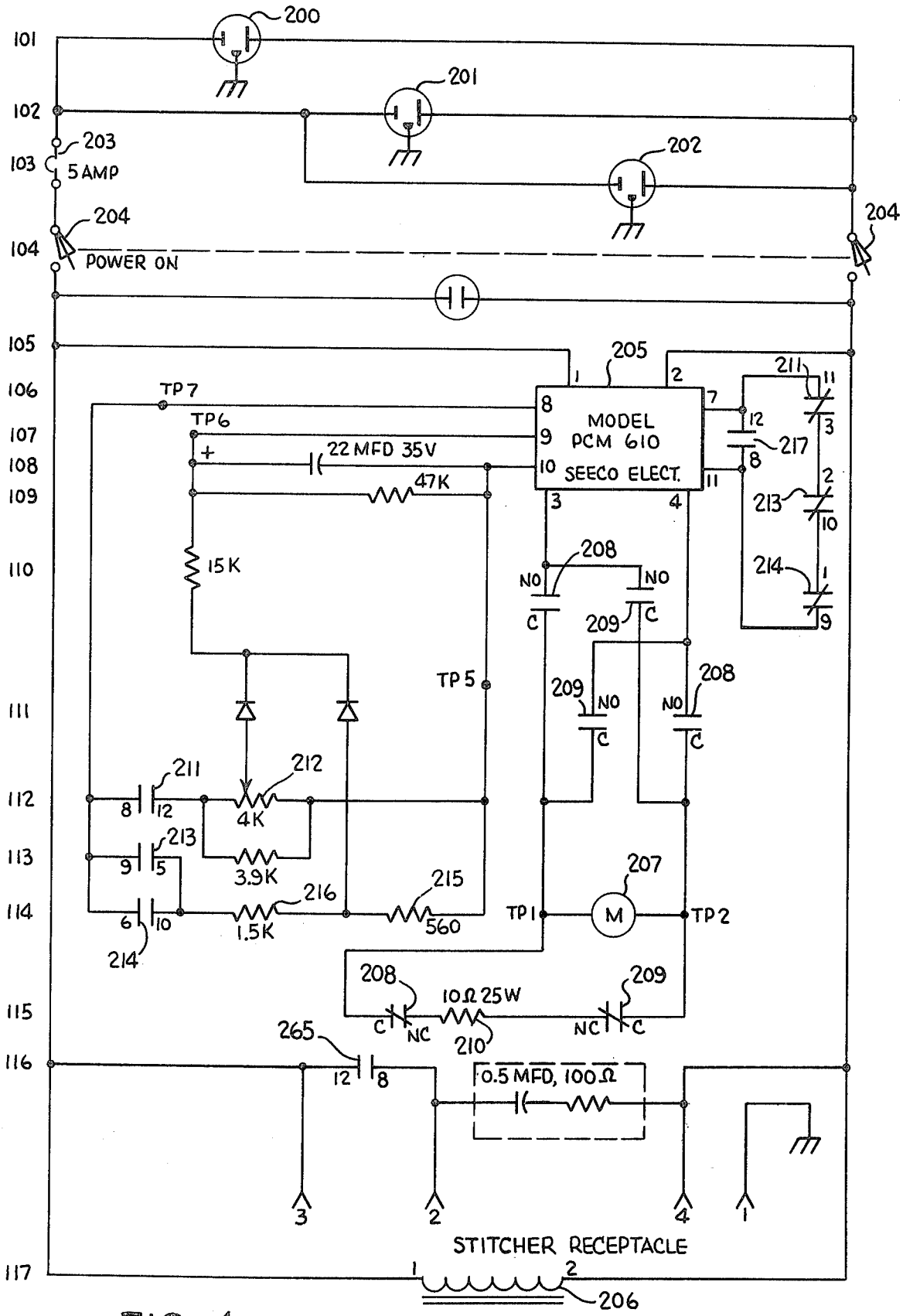
Figure 4B:
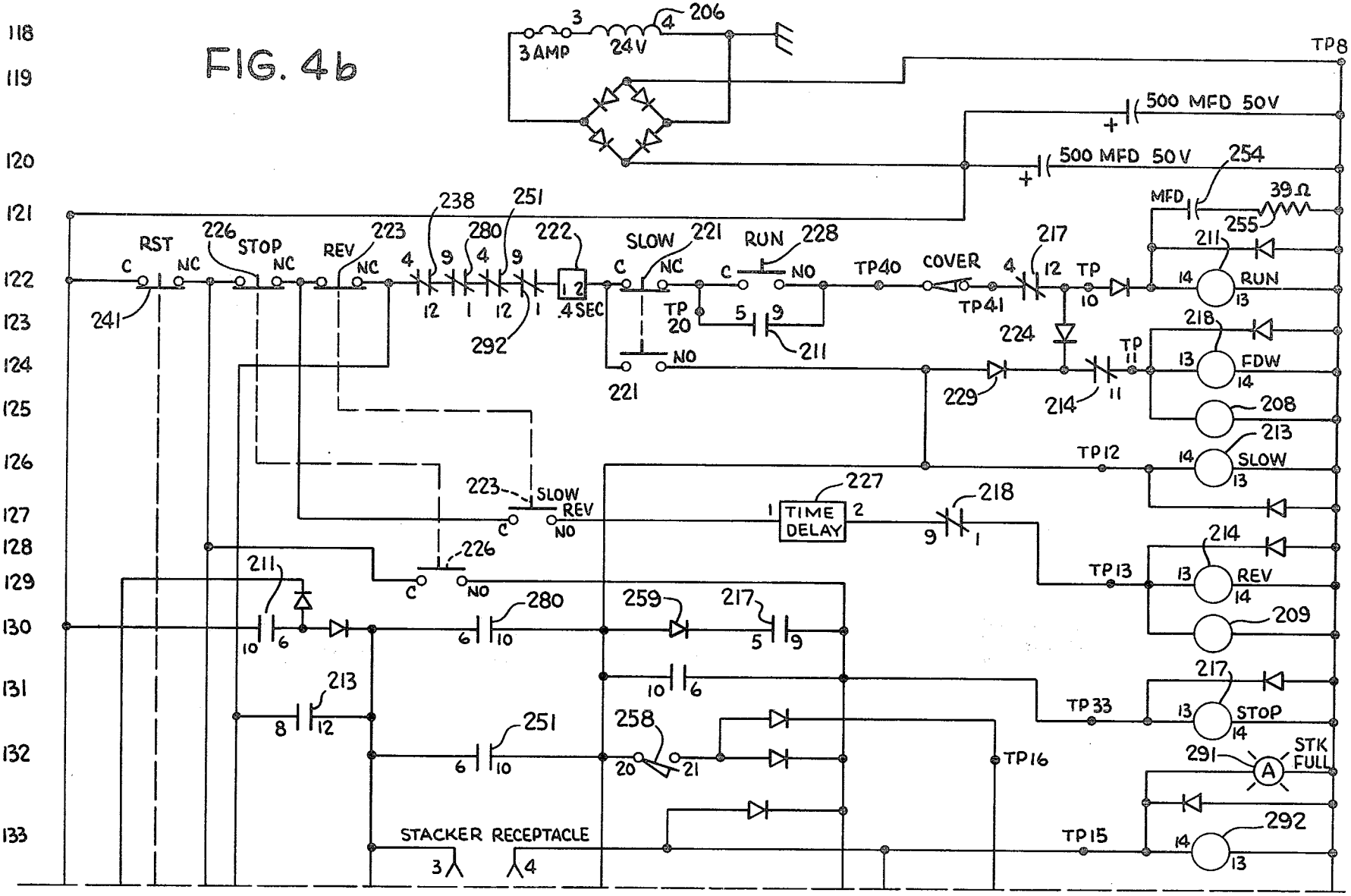
Figure 4C:
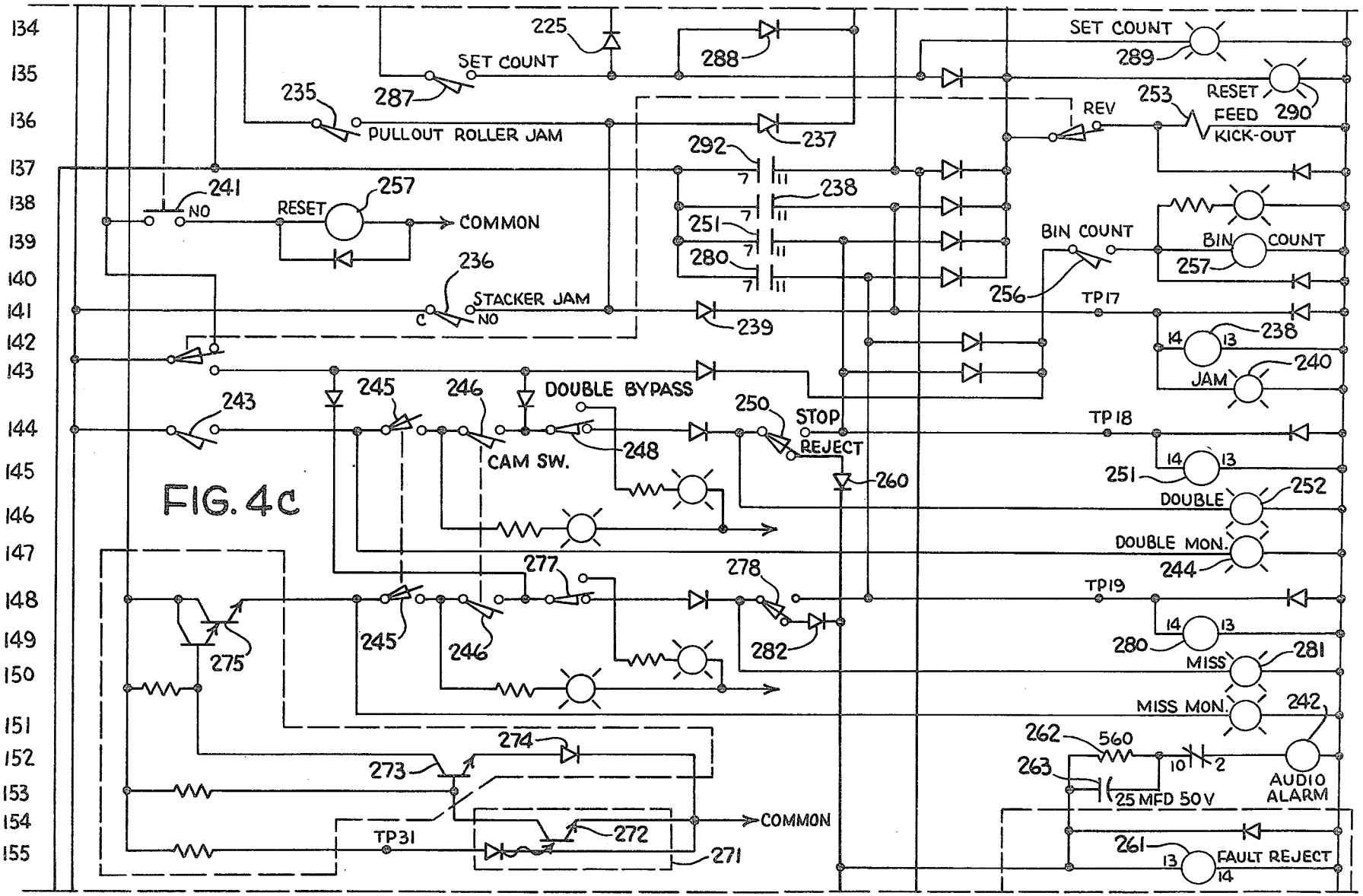
Figure 4D:
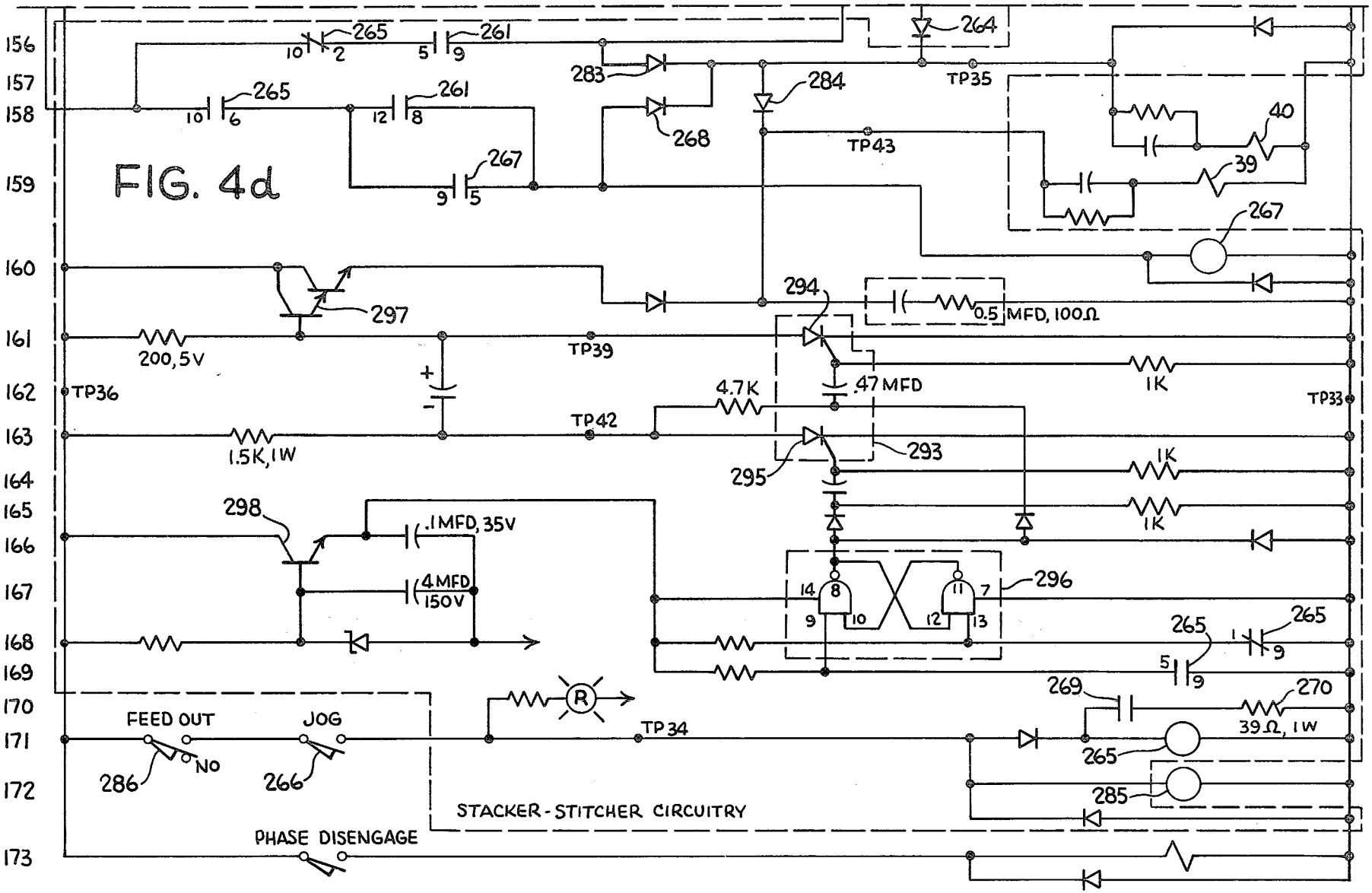

FIGS. 4*a* through 4*d* are electrical shematics of the circuitry of the inventive systems; the figures are to be viewed together in the lettered sequence presented, thus forming a complete electrical diagram of the circuitry necessary to practice, and forming part of, the invention;

FIG. 5 is a perspective view of the withdrawing mechanism and the inventive disengaging mechanism for the collator system of FIG. 1.

FIG. 5*a* is a front view of the disengaging cam shown in FIG. 5; and

FIG. 6 is a cam switch assembly for use in the collator system of FIG. 1.

Now referring to FIG. 1, a perspective view of a rotary drum collator 10 is shown.

This type of collator is disclosed and described in U.S. Pat. No. 3,970,297. Unless mentioned otherwise, the collator as used with this invention operates and is structured in the same manner as the prior machine.

The collator 10 has a rotating drum 11, that synchronously meshes (arrow 12) with a rotating (arrow 13) sheet withdrawing roller set 14 (spider).

Sheets of material are stored in the pockets 15 of the drum 11. Sheets within pockets 15 are withdrawn by means of the roller set 14. Each sheet 16 which is withdrawn from a pocket 15 is discharged (arrow 17) to a stacking deck 18. The deck 18 is vertically movable (arrows 19) within guides 20 (only one shown) in the frame walls 21.

Discharging sheets 16 are conveyed to the deck 18, where they are stacked (sets of stacks 22) in an off-set manner.

A sheet stopping mechanism is generally shown by arrow 23. The stopping mechanism 23 is movably supported on guide bars 24 (only one shown) secured to frame walls 21. The stopping mechanism 23 is slidable (arrows 25) along bars 24 to provide a longitudinal exit adjustment for discharging sheets 16.

Guide plates 26 are adjustably secured to the stopping mechanism 23 to provide a supportive guide to discharging sheets 16. The plates 26 are supported by respective straps 28 which are adjustably secured to the stopping mechanism 23 by thumb nuts 27 (see FIGS. 1 and 3). A lateral slot 29 allows each guide plate 26 to be slidably moved (arrows 30, FIG. 1) upon the stopping mechanism 23, so as to constrict or expand the discharge throat of the stacking area (lateral exit adjustment).

The stopping mechanism 23 has three movable stop members 31, 32 and 33, respectively, for providing three off-set positions for the discharged sheets 16.

With reference to FIG. 2, stop members 31 and 32 are respectively pivotable (arrows 34) about shafts 35 and 36, respectively. Stop member 33 is slidably movable (arrows 37) within a slot (not shown) disposed within bracket 38.

Solenoid 39 is pinned to stop member 31 by pin 41. When solenoid is actuated, the stop member 31 is caused to pivot upwardly (arrow 42) as depicted in FIG. 3*a*. A spring 43 (FIG. 2) causes the stop member 31 to return to its initial stopping position, when the solenoid 39 is deactuated.

Solenoid 40 is pinned to stop member 32 by pin 44. When solenoid 40 is actuated, the stop member 32 is caused to pivot upwardly similar to that of stop member 31. A spring 45 causes the stop member 32 to return to its rest (stopping) position, when the solenoid 40 is deactuated.

Stop member 33 is not solenoid controlled, but is manually slidable (arrows 37). Spring 46 biases stop member 33 to a downward stopping position.

With reference again to FIG. 1, a programming disc 47 is shown in the side wall 21 of the collator 10. This programming disc controls the collating cycle of the drum 11, and actuates and deactuates solenoid 39 (FIG. 2) to alternately raise and lower stop member 31. This provides for off-setting each stack of sheets (set) with every new collating cycle (there may be more than one collating cycle for each drum revolution depending on the size of the stack set).

A combination miss and doubles detector may be carried in housing 48 senses or may be mounted separately in the feed area 230 of the collator. These detectors sense the feeding condition of sheets 16 being discharged from the drum. When an improper feed condition is sensed, detectors 48 actuate solenoids 39 and 40 (FIG. 2) to pivot stop members 31 and 32 upwardly to a non-stopping position (FIG. 3*b*).

Now referring to FIG. 3, a lever 49 is shown pivotably mounted to a normally closed switch 50. When the incoming (arrow 23) sheets 16 are delivered to the deck 18, they will become stacked upon the deck. As the height of the sheets increase, they will press upwardly against the lever 49. The lever 49 will then be caused to pivot (arrow 51), thus closing switch 50. When the switch 50 is closed, a motor (not shown) is actuated to lower (arrow 19; FIG. 1) the deck. The deck will only lower a small incremental distance, because as the deck moves downwardly, the pressure is relieved against lever 49, and the switch 50 is caused to open again. Thus, it will be observed, that the deck 18 will be periodically lowered as each succeeding sheet build-up actuates switch 50, and each incremental lowering of the deck 18 will relieve switch 50 to allow for a subsequent sheet build-up.

A pair of push-bottom switches 52 and 53, respectively, depicted in FIG. 1, are also provided for raising or lowering (arrows 19) the deck 18. The switch 52 for raising the deck is needed at the end of each collator run, for returning the deck to its initial home position. Both switches 52 and 53 can be used as an aid to removing stacks from the deck, or for inspecting a given stack condition or quantity.

OPERATION OF THE STACKING APPARATUS

The operation of the stacking system will be described with particular reference to FIGS. 3, 3*a* and 3*b*.

As aforementioned, every revolution of the drum will provide at least one complete collated stack of sheets (set). More than one stack set may be obtained in a drum revolution by using the remaining pockets to load an additional stack set. There will be only one stack of sheets per drum revolution, if the number of drum pockets required to make a complete stack set requires more than half of the drum pockets. Each collated stack is required to be off-set from a prior stack, and a subsequent stack. This is accomplished by alternating stop member 31 (for each collating cycle) between a lower sheet stopping position as shown in FIG. 3, and an upper sheet non-stopping position depicted in FIG. 3*a*. Naturally, when the stop member 31 is in the raised position, the collated stack will comprise sheets 16 whose forward travel (arrow 23) has been terminated by stop member 32 (FIG. 3*a*). Thus, when the programming disc 47 of FIG. 1, initiates a new collating cycle, a new stack off-set position is achieved by actuation or deactuation of solenoid 39 (as the case may be). The cyclic actuation or deactuation of solenoid 39, will pivot (arrow 34) stop member 31 between the stopping and non-stopping sheet positions, as aforementioned. The alternating actuation and deactuation of solenoid 39 is operatively controlled by the programming disc 47 with the initiation of each new collating cycle, as previously stated.

In the event of an improper feed condition, a third off-set position is provided for the improperly collated stack as can be seen with reference to FIG. 3*b* and stack set 60 of FIG. 1. The incoming sheets 16 of an improperly collated stack will be stopped by the third stop member 33. In such a case (FIG. 3*b*) both stop members 31 and 32 are respectively raised (respective arrows 42 and 55) to their upper non-stopping position. This is achieved by actuating both solenoids 39 and 40 (FIG. 2). Naturally, if the solenoid 39 is already actuated by programming disc 47, it will just remain actuated, i.e. it will not require reactuation.

The actuation of both solenoids 39 and 40, as aforementioned, is controlled by the feed sensors 48 of FIG. 1. When an improper feed condition is sensed by sensors 48, such as when there is a mis-feed, the sensors 48 will actuate solenoids 39 and 40. This will then provide for a third off-set position for the sheets of this misformed stack.

The sensors 48 of this invention comprise a multiple feed (doubles) detector, as well as a missed sheet detector. Other detectors are obviously capable of being included or combined within the general detection scheme of sensors 48. Any improper feed condition that will produce an incomplete or improperly collated stack, is meant to be included within the function and scope of sensors 48.

The third stop member 33 is made slidably movable (arrows 17 of FIG. 2) to aid in the removal or inspection of the misformed stack.

Referring to FIG. 3*c*, an alternate embodiment is shown for the stopping members 31 and 32. Both the members 31 and 32 are movably pivotable at an angle with respect to the horizontal plane of the stacks. This is accomplished by angling shafts 35 and 41, and shaft 36 and 44 (not shown), respectively. Thus, when stopping members 31 and 32 move upwardly, they also pull away from the sheet edges of the stack. Member 32 is shown pulling away (arrow 57) from the stack as it moves upwardly (arrow 55). Member 31 acts in likewise fashion. This pulling away eliminates interference with the stack and increases operating speed.

FIGS. 4*a* through 4*d* are an electrical schematic of the circuitry of the inventive system. These figures are to be viewed together in their lettered sequence, thus forming a complete electrical diagram.

Power is supplied the circuit through the power intake receptacle 200 in line 101. Receptacles 201 and 202, respectively, (lines 102 and 103) are intended to supply power to accessory apparatus as such as a stitcher (stapling mechanism) and a stacker (mechanism for stacking deck 18 of FIG. 1). The circuitry of the collator system is protected by means of a circuit breaker 203 (line 103). Power is controlled by means of a DPST power switch 204 (line 104).

Line power is subsequently applied to the input of the motor speed control 205 (terminals 1 and 2; line 106). The motor speed control 205 controls the main drive motor 207 (line 114) for the drum 11 of FIG. 1. Line power is also applied to a stitcher receptable (line 116), and to the primary winding of transformer 206 (line 117).

The main drive motor 207 (line 114) is varied by changing the output voltage from control 205. The motor direction is reversed by reversing the output voltage from the control via interlocked power relays 208 and 209 (lines 125, 128, 110 and 111, respectively). Dynamic breaking is achieved by shunting the motor 207 with resistor 210 (line 115), when both relays 208 and 209 are dropped out.

The output voltage of the motor 207 is varied by adjusting the input divider network terminals 8, 9 and 10. The relay 211 (line 112 and 122) connects the speed control potentiometer 212 to the circuit defined by terminals 8, 9 and 10. The relay 213 (line 113 and 123) or the relay 214 (line 114 and 129) connect resistors 215 and 216 to the circuit defined by terminal 8, 9 and 10. Resistors 215 and 216 provide for a slow speed for the drum 11 (FIG. 1). The output on terminals 3–4 of the motor control 205 may be cut off by shorting terminals 7–11. Relays 211, 213, 214 or 217 can short terminals 7–11, cutting off the output to stop the collator (drum). Relays 208 and 218 (lines 125 and 124) and relays 209 and 214 (lines 128 and 127) control the forward and reverse directions for the motor drive.

Operator controls 220 (FIG. 1) are provided on the front of the collator 10. These controls provide for operating the machine in "slow", "reverse", "run" (standard adjustable operating speed), and "stop". To operate in slow, switch 221 (lines 122 and 124) is actuated. The normally closed contact of this switch will drop out the run circuit, when the switch is actuated. The normally open contact of switch 221 will energize time delay 222. Delay 222 is required in the event that the collator is running in reverse with switch 223 actuated, and the operator actuates slow switch 221 and releases switch 223. The time delay 222 allows for the inertial delay of the drum, as the drum comes to a stop while in reverse before starting forward. Relay 213 (slow) and relays 218 and 208 (forward), are then energized. Rectifier 224 (line 123) prevents relay 211 (line 122) from energizing, and rectifier 225 (line 133) prevents "set count"* from energizing. The relay (213) N.C. contact (line 108) which is normally closed opens to release the motor control (205) output. The N.O. contact of relay 213 (line 113) closes to connect the slow divider to motor control (205) terminals 8,9 and 10. The N.C. contact of relay 218 (line 127) opens insuring that reverse relays 214 and 209 (lines 127 and 128) will not energize. The normally open contacts of relay 208 (lines 110 and 111) close in order to apply the output of control 205 to the motor 207.

* The set counter counts the number of sets of collated stacks.

Releasing switch 221 drops out relay 213 (line 126) and relays 218 and 208 (lines 123 and 124). Relay contact 213 (line 108) closes to cut-off output of control 205, and opens (line 113) to disconnect the slow divider. Relay 208 contacts (lines 110 and 111) open to disconnect the motor 207 from the control 205, and close (line 115) to connect resistor 210 across the motor 207 to effect dynamic braking.

To operate in reverse, switch 223 (lines 122 and 127) is actuated. Its N.C. contact (line 122) opens to deenergize the run or slow circuits. If these circuits were energized with the fed paddle wheels 14 (FIG. 1) in a disengaged position. Switch 226 is released, and voltage is supplied to switch 223. The N.O. contact of switch 223 (line 128) energizes the time delay 227 (line 128). This time delay is necessary to allow the collator to come to a stop before going into reverse, if the collator had been in a slow or run condition when switch 223 is actuated.

After the time delay, relays 214 and 209 (lines 128 and 129) are energized. Relay 214 (contact in line 110) opens to release the motor control (205) output. Relay 214 (contact line 114) closes to connect resistors 216 and 215 to the slow divider network. Relay 214 in line 124 opens to prevent the energization of the "forward" relays 208 and 218. Relay 209 contacts (lines 110 and 111) close to connect the motor control 205 to the motor 207 (reverse output).

Releasing switch 223 drops out relays 214 and 209 (lines 128 and 129). Relay 214 contact (line 110) closes to cut-off the motor control (205) output. Relay 214 (contact in line 114) opens to disconnect the slow divider network. Relay 209 (contacts in lines 110 and 111) opens to disconnect the motor control 205 from the motor 207, and in line 115 closes to connect resistor 210 across the motor 207 to effect dynamic braking.

To operate in the run condition, switch 228 (line 122) is actuated. This will cause relays 211, 218 and 208 to energize, provided all the other contacts in line 122 are closed. Rectifier 229 (line 124) prevents the slow circuit from energizing. The normally closed contact of relay 211 (line 106) opens to release the motor control (205) output. The normally open contact of relay 211 (line 112) closes to connect resistor 212 to the motor control of output. Also, the normally open contact of relay 211 (line 123) closes to hold in the relay after switch 228 is released.

The relay 211 N.O. contact of line 130 closes energizing the "miss-detect" circuit. This circuit is energized only in the run condition, because this allows the operator to operate the collator in the slow condition without actuating the miss sensor 48 (FIG. 1). This is useful, because the operator can operate the machine in slow (in the middle of a set) and feed paper under detector 48 before actuating run. This applies to the case where the operator wants to engage feed in the middle of a set, (after a miss-feed or jam) where the programmed bypass circuit does not deactivate the miss circuit.

To stop the collator, the switch 226 is actuated (lines 122 and 129). The normally closed contact in line 122 opens, thus de-actuating the run, slow, and reverse circuits. The normally open contact of this switch (line 129) closes the energize relay 217. Relay 211 (contact in line 106), relay 213 (contact in line 109), relay 214 (contact in line 110) and relay 217 (contact in line 108) all close to cut off the output of the motor control 205. Relays 208 and 218 or relays 209 and 214 are de-energized to disconnect the output of the motor control 205 from the motor 207, and connect the braking resistor 210 across the motor 207.

In normal use, the slow control is used to position the collator drum during set-up and loading, and for initial feeding of sheets. The reverse control is used to position the drum, and to assist in clearing jams in the feed area 230, FIG. 1. The feed paddle where 14 must be disengaged (arrow 231, FIGS. 1 and 5) from engaging contact with the drum 11, when operating in reverse. This disengagement will be explained in more detail, hereinafter, with reference to FIG. 5.

The collator is equipped to detect a jam in the feeding and stacking of the sheets. Jam detectors (not shown) are placed in the feeding area 230, and in front of the stacking mechanism 23 shown in FIG. 1. These detectors are shown schematically in FIG. 4*c* as switches 235 and 236 (lines 136 and 141), respectively. Either of these switches will energize relay 217, via rectifier 237 (line 136) to stop the collator. Rectifier 237 isolates the jam circuit from the stop circuit. These switches will also energize relay 238 (line 142) via rectifier 239 (line 141). The normally closed terminals of relay 238 (line 122) open to drop out the run or the slow circuits. The normally open terminals of relay 238 (line 138) close, holding in the relay and the jam indicator light 240 (line 143), via the reset push button 241 (line 122). Rectifier 239 isolates the relay 238 holding circuit from the jam circuit. Switch 236 (stacker jam) must be released (cleared) and the jam circuit reset, before the collator can be operated. Switch 235 (feeding jam) is bypassed by the reverse switch 223 (line 122) to allow the drum to run in reverse to aid in clearing jams. After clearing a jam, reset switch 241 (line 122) must be actuated to de-energize relay 238 to allow operating the collator in slow or run.

OPERATION OF THE COLLATOR IN THE CYCLE/STOP AND RUN/REJECT MODES

As aforementioned, two modes of operation are available for correcting missed sheets and double sheets: (A) The RUN/REJECT mode for use with the stacker mechanism 23 and stacking deck 18 of FIG. 1; and (B) The CYCLE/STOP mode for use with the above-mentioned stacking equipment, or with a stitcher (not shown).

In the RUN/REJECT mode, the collator continues to operate when a fault is detected. The malfunction actuates the second stop 32 of the mechanism 23 (FIG. 1), so that the remainder of the faulty set will be off-set to a third position. The first two sheets of the following stack set are off-set where the last sheet of the previous set has been missed. This feature has been found to be necessary, because a miss on the last sheet will otherwise provide no visible indication of a faulty set.

Alarm 242 (line 153) is activated when there is a malfunction to notify the operator to take corrective action.

In the CYCLE/STOP mode, a malfunction causes the spider 14 (FIG. 1) to disengage (arrow 231) from feeding engagement with drum 11. The collator is then operated in the slow condition for a partial drum revolution of 45 pockets (there are 50 pockets in the drum), and the drum is then brought to a stop. This partial revolution of the drum positions the faulty pocket to the front the collator. This provides accessibility to the operator for correcting the malfunction, inspecting the faulty pocket, and restarting the collator.

The "miss" and "doubles" detectors 48 are located in the feed area 230 of FIG. 1. In the schematic, the doubles detector is represented by the switch 243 (line 144). The doubles detector is a percision low differential travel microswitch, which the operator sets to close with the thickness of two sheets, and open with the thickness of one sheet beneath the switch roller. The doubles monitor lamp 244 (line 147) is operative directly from switch 243. This allows the operator to check the setting of the switch, and also to observe its operation during a run.

Switch 245 (lines 144 and 148) is located on control panel 220 (FIG. 1), and is used to switch off the detector system during set-up, or after a malfunction has occurred.

A cam switch 246 (lines 144 and 148) is used to connect the detection system into the circuit at the proper instant that the center of a discharged sheet (i.e. a sheet withdrawn from a pocket 15 of drum 11 by the spider 14) passes beneath the sensors 48 (FIG. 1). The cam switch is of the type shown in FIG. 6 with two normally open contacts. The cam 247 for the cam switch 246 is operatively connected to the spider shaft 298 (FIGS. 1 and 5). The switch 246 closes and connects the detection circuit during 135° to 165° of rotation after each friction wheel 14*a* of the spider contacts a sheet in a pocket 15. The degree of rotation (135° to 165°) represents the approximate time lapse necessary for sheet travel between the initial paper contact by a wheel 14*a* and its positioning under the sensors 48 (FIG. 1).

Naturally, the spider 14 must be engaged in order that switch 246 be operative.

A doubles bypass switch 248 (line 144) is located behind certain ones of the programming pins 249 of the program disc 47 (FIG. 1). The bypass switch 248 is made operative to deactuate certain ones of the pockets 15 from a doubles malfunction detection. This is useful where extra heavy sheet stock is being used to bind the booklet (stack).

Switch 250 (line 144) which is located on the control panel 220 of FIG. 1, allows the operator to select either the CYCLE/STOP or the RUN/REJECT mode. When a double sheet is fed, and switch 250 is in the CYCLE/-STOP position, relay 251 (line 145) is energized. Relay 251 (contact in line 122) opens to de-energize the run and slow circuits, and closes in line 139 to hold in relay 251 and doubles indicator light 252 (line 146). When this happens, the kick-out solenoid 253 (line 136) is activated. The kickout solenoid 253 is used to disengage the spider wheels 14 from feeding engagement with drum 11, as will be explained in more detail hereinafter, with respect to FIG. 5.

Relay 251 (contact in line 132) closes energizing relay 213. The drop out of relay 211 (line 122) is delayed by means of capacitor 254 and resistor 255 (line 121) to allow relay 213 (contact in line 131) to close before relay 211 (contact in line 130) opens. This allows the collator to continue to operate in the slow condition. Relay 251 (line 139) also energizes switch 256, which in turn energizes the bin (pocket) counter 257. A cam and switch assembly similar to cam 247 and switch 246 shown in FIG. 6, is operatively connected to drum 11 (FIG. 1). As the drum rotates, pulses are provided by switch 246 for each pocket 15 of the drum. The bin counter 257 counts these pulses, and when a count is reached corresponding to the passage of 45 pockets, the drum 11 is stopped from rotating. This is accomplished by closing the counter switch 253 (line 132) closing at the present bin count. Relay 217 (line 131) will then energize. Relay 217 contacts (line 130) close to hold in the relay 217. Relay 217 (line 107) closes to cut off the speed control (205) output to stop the motor 207, and hence, the drum.

Having rotated 45 bins (pockets), the drum stops at a position where the faulty pocket is easily accessible to the operator.

Rectifier 259 (line 130) isolates the stop circuit from the slow circuit, so that relay 217 only latches in when energized by the slow circuit.

When switch 250 (line 144) is in the RUN/REJECT mode position and a double sheet is fed, relay 251 (line 145) is not energized. The doubles signal is applied through rectifier 260 (line 145) to relay 261 in line 155, and to audio alarm 242 (line 153) through resistor 262 and capacitor 263. The resistor 262 and capacitor 263 serve to drop the voltage and apply an overenergize voltage to alarm 242 for approximately 10 ms to decrease its response time. The doubles signal is also applied to reject solenoid 40 of the stacking mechanism 23 of FIG. 2 via rectifier 264 (line 156). Solenoid 40 is represented on the electrical schematic on line 158. It will be recalled, that solenoid 40 activates the second stop 32 (FIGS. 2 and 3*b*) so as to allow the subsequent sheets of the defective stack to obtain a third stacking position via stop 33.

The front stop 31 is also pulled by solenoid 39, if it is not already activated. Solenoid 39 is represented in the schematic on line 159.

Relay contacts 261 on line 156 close to hold in the relay 261 (line 155) and the two solenoids 39 and 40.

Relay 261 is dropped out when relay 265 is operated by the jog switch 266 (line 171). Relay 265 (contact in line 156) opens dropping relay 261, and closes in line 158 energizing relay 267 (line 160). Relay 267 latches through relay contacts 267 in line 159.

Relay 267 holds in the solenoids 39 and 40 via rectifier 268 (line 158), until relay 265 is de-energized by jog switch 266. Capacitor 269 and resistor 270 of line 170 delay the drop-out to insure that the doubles sheet will be rejected at high speed.

Relay 261 (line 158) opens to drop-out relay 267 and solenoids 39 and 40, to return the collator to a normal stacking sequence.

A miss detector 271 (lines 154 and 155) is located in the feed area 230 (FIG. 1). The miss detector is a photoelectric reflective type detector emitting an infrared light beam. When a paper intercepts the light beam to receptor 272 (line 154) receptor 272 is cut off. The system is unaffected by reflections off the paper surface since the paper is forward of the reflective focal plane.

When the light beam is completed to receptor 272, as when there is a miss, the receptor 272 conducts. This pulls down the voltage applied to the base of transistor 273 (line 152). This cuts off transistor 273. The rectifier 274 increases the reverse bias on the transistor 273 to help cut if off. The collector voltage then rises to allow the darlington 275 (line 148) to turn on.

The miss detector 271 only has power when the collator is being operated in run (relay 211 from line 130).

When the darlington 275 turns on voltage is supplied directly to monitor 276 in line 151. This monitor is on the control panel 220 (FIG. 1) to inform the operator of a miss. Switch 245 (lines 144 and 148) is used to switch the detection circuit off, if so desired.

As aforementioned for the doubles detection, cam switch 246 (line 148) similarly activates the miss detection system at the proper instant that a sheet of paper is directly below the sensor housing 48 (FIG. 1).

A miss bypass switch 277 (line 148) is located behind certain pins 249 of the programming disc 47 of FIG. 1. These pins can deactivate the miss detection circuitry for any pockets of the drum which are empty during a collating cycle.

Switch 278 (line 148) is located on the operator panel 220 (FIG. 1), and allows the operator to select either the CYCLE/STOP or RUN/REJECT mode. When a sheet is missed, and the switch 278 is positioned for CYCLE/STOP, relay 280 (line 149) is energized, the miss indicator light 281 (line 150) lights, and the feed kick-out solenoid 253 is energized to disengage the spider 14 (FIGS. 1 and 5), as will be explained hereinafter.

Relay 280 also closes in line 130, which energizes relay 213. Capacitor 254 and resistor 255 (line 121) delay the drop-out of relay 211 so as to allow relay 213 to close before relay 211 opens (line 130). This allows the machine to continue running slowly.

Relay 280 (line 140) also energizes switch 256 (line 139). This in turn, energizes the bin counter 257. When 45 bins (pockets 15) have been counted, counter contact 258 (line 132) closes to energize relay 217. Relay 217 contact (line 130) closes to hold in relay 217. Relay 217 (line 107) closes to cut off the speed control (205) output, which stops the motor 207 and the drum. The faulty bin is now at an operator accessible position.

When a sheet is missed, and switch 278 is positioned in the RUN/REJECT mode, relay 280 is not energized, although the indicator 281 is energized. The miss signal is applied through rectifier 282 to relay 261 (line 155) and audio alarm 242 through resistor 262 and capacitor 263. The signal is also applied through rectifier 283 (line 157) to solenoid 40 and rectifier 284 (line 158) to solenoid 39.

Relay 261 (line 156) closes holding in relay 261 and the two solenoids, allowing sheets to travel to the reject position 60 (FIG. 1).

Relay 261 is dropped out, when the relay 265 is actuated by jog switch 266. Relay 265 (line 156) opens dropping relay 261. Relay 265 closes (line 158) energizing relay 267, which latches through contact 267 (line 159). The relay 267 holds in solenoids 39 and 40 via rectifier 268 (line 158) until relay 265 is de-energized by the jog switch. Relay 265 (line 158) opens dropping relay 267 and allowing the stacker mechanism solenoids 39 and 40, to return to their normal sequence of operation.

The relay 267 circuit effectively holds the solenoids 39 and 40, energized until relay 265 is de-energized. This delay (resistor 270 and capacitor 269 circuit) causes two additional sheets to be fed to the reject position before the solenoids return to their proper sequence. Therefore, if there is a miss on the last sheet of a stack, the first two sheets of the next stack will be sent to the reject position 60 (FIG. 1). This will identify a defect, which in all probability would have gone undetected. Rectifier 284 isolates the second stop solenoid 40 from the first stop solenoid 39. This rectifier effectively divides the solenoid operation into two separate circuit paths: (a) a first circuit path allowing only the first stop solenoid 39 to alternate in an up-and-down sequence in accordance with normal operation (as will be explained hereinafter); and (b) a second circuit path which pulls both solenoids in response to a fault signal.

The stacker may be pre-set to stop after collating a given number of sets, by adjusting the set counter 285 (line 172) to the desired quantity. The set counter 285 is energized by the jog switch 266 for each stack set (each new collating cycle). The jog switch 266 operates off a selected pin of the programming disc 47 (FIG. 1). The pin monentarily closes switch 266 every new collating cycle. A holding circuit (to be explained hereinafter) holds the first stop solenoid 39 in, if the solenoid is to provide the second of the two off-set positions.

The set counter 285 is only energized when the feed paddle is engaged and actuating the feed switch 286 (line 171). At a pre-set count, line 135 closes via switch 287 energizing relay 217 via rectifier 288 (line 134), and relay 213 via rectifier 225. Relay 213 serves as a holding contact after relay 211 is de-energized. Relay 217 (line 107) cuts off the speed control output stopping motor 207 and, hence, the drum. The set count switch 287 also energizes the set count indicator light 289 (line 134) and the reset light 290 (line 135).

The operator then resets both switch 241 (line 122) and counter 285 (line 172) and reloads the drum for the next collator run.

When the stacker is full, "stack full" indicator light 291 (line 132) comes on. The solenoids 39 and 40 are pulled up to allow easier access to, and removal of, the sets disposed on the deck 18 (FIG. 1). The stack full relay 292 (line 133) is energized by a stack full switch (not shown) which is located in the stacker area and is part of the deck drive. The signal from this switch is fed through the stacker receptacle leads shown in line 133 of the schematic. This signal is only present in the run condition (relay 211 is closed line 130) so that the stacker full circuit will not interfere during set up).

Relay 217 is energized via rectifier 293 (line 132) to de-energize relay 211, and stop the collator. Relay 292 latches in via relay terminals 292 in line 137. Light 291 is energized. Contacts 292 in line 122 open to prevent energization of the run or slow circuits. Voltage is applied to solenoids 39 and 40 to pull them via rectifier 264 (line 156). After removing the collations (sets) from the deck 18 (FIG. 1), the operator resets the circuitry via switch 241, raises the deck to its upper position via button 52 (FIG. 1).

The drum 11 (FIG. 1) of the collator has 50 bins (pockets). Therefore, one set of up to 50 sheets can be collated for every drum revolution, or two sets of 25 sheets, etc. In order to program the collator for the number of sheets desired in each stack set, certain pins 249 of disc 47 (FIG. 1) are pushed. The jog switch 266 (line 171) is actuated by a pin 249 that is pushed-in on the disc. The disc 47 rotates along with the drum 11, and the pushed-in pin 249 momentarily contacts the switch 266 every collating cycle.

The set counter 285 and relay 265 (lines 172 and 171) are energized, if the feed switch 286 is closed (spider 14 is engaged). The contacts of relay 265 (lines 168 and 169) initiate the alternate acting flip-flop 293 comprising SCR's 294 and 295 of lines 161 and 163, via the anti-bounce circuit 296 (lines 166–168).

When SCR 294 is energized, it pulls down the base of darlington 297 (lines 160–1). This holds the first stop solenoid 39 off. When the first jog signal occurs, (momentary closing of switch 266) the output of the anti-bounce circuit 296 rises and pulses the SCR's. Although this pulse is differentiated, and is applied to both SCR's 294 amd 295, only the SCR 295 is turned on (SCR 294 is already on). When the SCR 295 turns on, negative pulse is applied to the anode of SCR 294, turning SCR 294 off. The anode voltage of SCR 294 rises, allowing darlington 297 to turn on and energize the front stop solenoid 39.

When the next collating cycle is initiated, the jog switch 266 momentarily closes again. This allows relay 265 and circuit 296 to turn on SCR 294 and turn off SCR 295 (reverse their state). This results in de-energizing solenoid 39. Thus, it will be seen, that during normal operation, each stack set will obtain an off-set position from a prior and a subsequent stack set (alternating energizing and de-energizing of solenoid 39 for each collating cycle). It should be stressed agains, that solenoid 40 (second stop solenoid) is not effected by darlington 297 because of the isolation provide by rectifier 284.

Now referring to FIGS. 5 and 5*a*, the spider 14 for withdrawing sheets from drum 11 (FIG. 1) is shown in more detail. Also, the disengagement mechanism for the spider is shown generally by arrow 300.

The spider 14 consists of a plurality of friction wheels 14*a*. These wheels engage with the sheets in the pockets 15 of drum 11 (FIG. 1) as the spider rotates (arrow 13) in synchronism with the drum (arrow 12). The spider 14 (pair of wheels mounted on shaft 298) is pulled rearwardly (arrow 231) every time disengagement is desired. This is possible because the rotatable shaft 298 is rotatably mounted upon slidable frame members 299.

Disengagement of the spider 14 is initiated by actuating kick-out solenoid 253. The solenoid plunger 301 is then pulled downwardly (arrow 302). This causes the bell crank 303 to pivot (arrow 304) about its pivot 305 against the biasing of spring 306.

A pin 307, which is slidably mounted in the hollow shaft housing 308, is then caused to project into the rotating path of kick-out cam 310. Cam 310 is fixed to shaft 298 and rotates (arrow 309) along with the spider 14.

When the pin 307 is projected into the path of the rotating kick-out cam 310, one of the star leaf projections 311 will hit against the pin 307 as shown in FIG. 5*a*. This will cause the cam 310 to cam itself rearwardly (arrow 231). Becuase the cam 310 is part of the spider assembly (attached to shaft 298), the spider 14 and the frame members 299 will also move rearwardly. Thus, the spider 14 will become disengaged, when the kick-out solenoid 253 is actuated.

It will be seen by the foregoing discussion, that the inventive purposes and objectives have been properly attained and described.

Naturally, many alternate structural designs and circuitry will occur to the skilled practitioner for practicing this invention. It is, therefore, deemed that all obvious modifications, changes or alternative designs be considered as forming part of the inventive scope, and falling within the limits of the invention, as presented by the appended claims.

What is claimed is:

1. A rotary drum collator, comprising:

a rotatable drum having a plurality of pockets for storing quantities of sheet material to be collated into stacks, said pockets being angularly arranged about the drum;

a rotatable spider mechanism disposed adjacent said drum for rotating in synchronism with the drum to remove the sheet material from the pockets of said drum, said spider mechanism being movable from a first sheet removing position to a second non-removing sheet position;

disengaging means disposed adjacent said spider mechanism for movably engaging with said spider mechanism for causing said spider mechanism to move from said first sheet removing position to said second non-removing sheet position with respect to said drum; and sensing means disposed adjacent said drum for sensing a sheet feeding malfunction, said sensing means being coupled to said disengaging means for causing said disengaging means to move into engaging contact with said rotating spider mechanism for moving said spider mechanism from said first sheet removing position to said second non-removing sheet position in response to the sensing of a sheet feeding malfunction.

2. The rotary drum collator of claim 1, wherein said sensing means comprises a miss-detector for detecting a mis-feed of a sheet of material from a pocket of said drum.

3. The rotary drum collator of claim 1, wherein said sensing means comprises a multiple feed detector for detecting the feeding of more than one sheet of material from a pocket of said drum.

4. The rotary drum collator of claim 1, wherein said disengaging means comprises a rotating cam connected to said spider mechanism and rotatable therewith, and a solenoid controlled extension pin for engaging with said rotating cam in response to a sheet feeding malfunction and causing said cam to push away from the extension pin, whereby the spider mechanism is caused to move from said sheet removing position with respect to the drum.

5. A rotary drum collator, comprising:

a rotatable drum having a plurality of pockets for storing quantities of sheet material to be collated into stacks, said pockets being angularly arranged about the drum;

a supporting frame for supporting said drum;

a rotatable spider mechanism disposed upon said supporting frame adjacent said drum for removing sheet material from each of the pockets of said drum, said spider mechanism being movable from a first sheet engaging position to a second non-engaging sheet position;

disengaging means operatively engageable with said spider mechanism for moving said spider mechanism from said first engaging position to said second non-engaging position so that the spider mechanism is rendered incapable of removing sheet material from said pockets; and electrical sensing means operatively disposed adjacent said drum for sensing a sheet feeding malfunction, said sensing means being electrically coupled to said disengaging means for causing said disengaging means to engage with said spider mechanism for disengaging said spider mechanism from rotative engagement with said sheet material in the response to the sensing of a sheet feeding malfunction.

6. The rotary drum collator of claim 5, wherein said sensing means comprises an optical miss-detector for detecting a mis-feed of a sheet of material from a pocket of said drum.

7. The rotary drum collator of claim 5, wherein said electrical sensing means comprises a multiple feed detector for detecting the feeding of more than one sheet of material from a pocket of said drum.

8. The rotary drum collator of claim 5, wherein said disengaging means comprises a rotating cam connected to said spider mechanism and rotatable therewith, a solenoid controlled extension pin for engaging with said rotating cam and causing said cam to push away from the extension pin, whereby the spider mechanism is caused to move from an engaging position with the sheet material in the drum.

9. The rotary drum collator of claim 8, wherein said cam is star-shaped.

10. The rotary drum collator of claim 8, wherein said solenoid controlled extension pin is connected to a solenoid by means of a bell crank, said bell crank being caused to pivot in response to actuation of the solenoid, such that said extension pin is caused to project into a rotating path of said rotating cam.

* * * * *